US006506916B2

(12) United States Patent
Bertholet

(10) Patent No.: US 6,506,916 B2
(45) Date of Patent: Jan. 14, 2003

(54) PROCESS FOR REFINING FATTY SUBSTANCES

(75) Inventor: Raymond Bertholet, Blonay (CH)

(73) Assignee: Nestec S.A., Vevey (CH)

( * ) Notice: Subject to any disclaimer, the term of this patent is extended or adjusted under 35 U.S.C. 154(b) by 27 days.

(21) Appl. No.: 09/780,899

(22) Filed: Feb. 9, 2001

(65) Prior Publication Data

US 2001/0005759 A1 Jun. 28, 2001

Related U.S. Application Data

(63) Continuation of application No. PCT/EP94/05333, filed on Jul. 20, 1999.

(30) Foreign Application Priority Data

Aug. 11, 1998 (EP) ..... 98202698

(51) Int. Cl.[7] ..... C11B 3/00
(52) U.S. Cl. ..... 554/202; 554/175; 554/195
(58) Field of Search ..... 554/175, 195, 554/202

(56) References Cited

U.S. PATENT DOCUMENTS

| | | | | |
|---|---|---|---|---|
| 2,844,613 A | 7/1958 | Cousins et al. | ..... | 260/425 |
| 3,008,972 A | 11/1961 | Mitani | ..... | 260/425 |

FOREIGN PATENT DOCUMENTS

| | | | |
|---|---|---|---|
| GB | 596871 | * | 1/1948 |
| GB | 1520523 | | 8/1978 |
| JP | 50103506 | | 8/1975 |
| JP | 4370195 | | 12/1992 |
| JP | 5306400 | | 11/1993 |

OTHER PUBLICATIONS

A.C. Bhattacharyya et al., "Edible Quality Rice Bran Oil from High FFA Rice Bran Oil by Miscella Refining", *Journal of the American Oil Chemists' Society,* vol. 63, No. 9, pp. 1189–1191 (1986).

* cited by examiner

*Primary Examiner*—Deborah D. Carr
(74) *Attorney, Agent, or Firm*—Winston & Strawn

(57) ABSTRACT

A process for refining fatty substances in order to selectively and quantitatively separate therefrom the free fatty acids. The process combines the extraction with an alcohol or a polyol and a neutralization is conducted with an alkali at a controlled pH of 9 to 11.

16 Claims, No Drawings

PROCESS FOR REFINING FATTY SUBSTANCES

CROSS-REFERENCE TO RELATED APPLICATIONS

This application is a continuation of the U.S. national stage designation of International Application PCT/EP99/05333 filed Jul. 20, 1999, the content of which is expressly incorporated herein by reference thereto.

FIELD OF INVENTION

The invention relates to the refining of fatty substances, in particular of oils, in order to selectively free them from most of their free fatty acids.

BACKGROUND ART

In the treatment of fatty substances, the removal of free fatty acids is a major step, the aim of which is to lead to oxidation, products with good stability and good organoleptic qualities.

The following process for removal of free fatty acids from fatty substances are known in the art: alkaline refining, refining micelles, steam distillation, liquid/liquid extraction and membrane or chromatographic separation. Among these known methods, only alkaline refining and steam distillation are applied on an industrial scale.

These known methods have disadvantages. For example, some of the disadvantages of alkaline refining are loss of neutral oil by saponification, occlusion of soaps in the neutral oil, elimination of active phenolic compounds and the need to treat the soaps. By way of illustration, a process for refining oils containing fatty acids as impurities by neutralizing the crude oils with an aqueous alkaline solution containing a polyol and separating the purified oils from the soaps formed is known, for example, from FR-A-2321537.

One of the disadvantages of steam distillation is that it takes place at high temperature and under a high vacuum, which causes losses of volatile nutrients, for example tocopherols, undesirable chemical changes, for example formation of trans fatty acids, changes in color and polymerizations.

An object of this invention is to provide an industrially applicable process which selectively and quantitatively removes the fatty acids without exhibiting the above mentioned disadvantages.

SUMMARY OF THE INVENTION

The present invention provides a process for removal of free fatty acids from fatty substances or oils. In particular, this process comprises removal of free fatty acids by a controlled neutralization, at a temperature greater than the melting point of the fatty substances, in an aqueous medium containing an alcohol or a polyol. A base is gradually added to the reaction medium so as to maintain the pH at 9–11, which leads to partition of the free fatty acids between a lipid phase and an aqueous phase containing the alcohol or the polyol, that is nonmiscible with the lipid phase. The formation of soaps, which are solubilized progressively in the aqueous phase, produces a shift in the equilibrium and a gradual deacidification of the lipid phase until the pH has stabilized, in that the two phases are separated and in that the deacidified lipid phase is collected, from which the alcohol or the polyol is removed.

DETAILED DESCRIPTION OF THE PREFERRED EMBODIMENTS

In the text which follows, fatty substances will be called "oils" for the sake of simplicity.

According to a first embodiment of the process, the controlled neutralization of the fat containing free fatty acids is carried out in a reactor equipped with a pH electrode, with a stirrer and a pH-stat equipped with a burette delivering an aqueous alkaline solution. The pH-stat is connected to the pH electrode so as to provide the alkaline solution as required when a set pH value, for example 9.5, is reached.

The reaction is carried out in the presence of alcohol, in a homogeneous medium with slow stirring, at a temperature greater than the melting point of the fatty substance and less than the azeotropic boiling point of the aqueous-alcoholic mixture, preferably at room temperature. The stirring conditions chosen are such that the lipid phase and the aqueous-alcoholic phase remain separated during the neutralization, which makes it possible to avoid the formation of stable emulsions due to the presence of soaps. The pH electrode is in contact with the aqueous-alcoholic phase alone. In this embodiment, the neutralization lasts for 6 to 20 h depending on the pH chosen for the neutralization, depending on the characteristics of the equipment and depending on the nature of the initial fat. The fat:alcohol volume ratio used is 1:0.5 to 1:2.5.

It is possible to use, as alcohol, a $C_1$–$C_3$ alcohol, preferably ethanol or 2-propanol.

In a preferred embodiment, allowing easier application on an industrial scale, the process according to the invention may be carried out in a heterogeneous medium, with vigorous stirring, in the presence of an alcohol or a polyol at a temperature of 40 to 80° C., with a pH of 9–11 and in a simple manner, without using a pH-stat. The quantity of alkali just required for the neutralization is calculated, without excess of alkali, relative to the quantity of free fatty acids present, determined for example by calorimetric titration. The neutralization may be carried out in about 60 min. As polyol, there may be used glycerol, propylene glycol, ethylene glycol or a polyalkylene glycol, in particular a polyethylene glycol, propylene glycol or a polyethylene glycol being preferred, anhydrous or diluted with water. The polyol:fat weight ratio may be, preferably, from 0.5:10 to 1:1.

The advantage of using a polyol is being able to work in conventional plants, that it is not necessary for the plant to be constructed in order to withstand explosions with a device for recovering the solvents.

Regardless of the variant of the process, it is possible to use, as alkali, an aqueous solution of KOH or of NaOH at concentrations of 1 to 40% by weight.

A decisive advantage of the process according to the invention is that, in contrast to conventional refining processes, it is not necessary to add alkali in excess for the neutralization. The weakly acidic phenolic substances are thus preserved and the alkaline hydrolysis of the triacylglycerols avoided.

Furthermore, it is not necessary to know precisely either the quantity of fatty acids present in the fat, or the weight of the fat to be neutralized.

EXAMPLES

The following examples illustrate, bud do not limit, this invention. . In these examples, the parts and proportions are by weight, unless otherwise stated.

Examples 1–3

100 g of filtered coffee oil, that is to say degummed and dewaxed in a conventional manner, are introduced into a 400-ml beaker, provided with an anchor-shaped stirrer, containing an Inlab 420 (R) pH electrode (Mettler-Toledo, Greifensee, CH) connected to a pH-stat (Metrohm 620 (R), Impulsomat 614 (R), Dosimat 645 (R)) provided with a glass reactor, a 20-ml glass cylinder and a burette (Metrohm, Herisau, CH) combined with a pipette delivering an alkaline solution. The coffee oil contains 4.85% of free fatty acids as measured by calorimetric titration in methanol/hexane non-aqueous medium with an ethanolic solution of KOH using phenolphthalein as pH indicator (IUPAC 2.201 method).

100 ml of 94% aqueous ethanol (Fluka, Buchs, CH) are added to the reaction mixture and the mixture is moderately stirred at 70 rpm at room temperature. The moderate stirring makes it possible to work in a homogeneous medium, avoiding the mixing of phases and the formation of an emulsion. The pH value is then set by means of the pH-stat. The pH electrode as well as the pipette delivering the alkaline solution are placed such that they are completely present in the aqueous-alcoholic phase. The system for delivering the aqueous KOH solution at 85% is switched on and controlled automatically during the reaction. When there is no longer consumption of alkali, the system is stopped manually. The two phases are then separated by settling out and the fatty phase is washed by stirring it moderately with 50 ml of aqueous ethanol. The aqueous phases are then removed. The fatty phase is dried under vacuum (80° C./25 mbar) and the loss of neutral lipids is determined by differential weighing. The deacidified oil is treated with 1% of adsorbent (Trisyl 300(R)) at 80° C./15 min so as to remove the residual soaps, and then it is dried under vacuum at 80° C./25 mbar for 15 min. After filtration, the quantity of residual free fatty acids is finally determined by potentiometric titration (IUPAC 2.201 method).

By way of comparison (Comparative Example 1), conventional neutralization of the preceding coffee oil is carried out in the following manner: 100 g of degummed and dewaxed coffee oil are treated at 70–80° C. in a 400-ml glass beaker provided with a stirrer. A quantity of 30% aqueous KOH solution, equivalent to the content of free fatty acid measured by calorimetric titration with phenolphthalein, plus an excess of 2 to 5%, are added thereto over 2 min. The mixture is then stirred for 5 min at 70–80° C. and it is centrifuged at 3000 rpm, at 60° C. for 10 min. The fatty phase is separated and the loss of neutral oil is determined by differential weighing. The deacidified oil is then treated with 1% of adsorbent (Trisyl(R)) at 80° C. for 15 min so as to remove the residual soaps therefrom, and finally the oil is dried under vacuum at 80° C./25 mbar for 15 min. After filtration, the quantity of residual free fatty acids is determined by potentiometric titration (IUPAC 2.201 method).

Table 1 shows neutralization conditions and results obtained by the processs of the present invention, compared to that of conventional neutralization. It is observed that the loss of free fat decreases by a factor greater than 3 when a process according to the invention is used compared with a conventional neutralization.

TABLE 1

| Example | Water in ethanol (%) | Neutralization pH | Alkali, 5N KOH (ml) | Duration (h) | Free fatty acids (%) | Losses of neutral lipids (%) |
|---|---|---|---|---|---|---|
| 1 | 10 | 11 | 3.32 | 17 | 0.2 | 2.8 |
| 2 | 15 | 9.5 | 3.28 | 20 | 0.29 | 2.5 |
| 3 | 15 | 11 | 3.34 | 20 | 0.22 | 2.7 |
| Comparative 1 | — | — | 3.5 | — | 0.23 | 9.5 |

Examples 4–9

A degummed and dewaxed rice bran oil is treated in a conventional manner, under conditions similar to those of Examples 1–3 . Thus, 100 g of oil containing 9.14% of free fatty acids and 1.57% of oryzanol are introduced into a beaker and brought into contact with 150 ml of aqueous ethanol (Fluka, Buchs, CH), with moderate stirring at 75 rpm, at room temperature. The pH is set at different set values by means of a pH stat and the system for delivering an aqueous solution of alkali is switched on as described above. At the end of the neutralization reaction, the contents of free fatty acids and of oryzanol are determined by potentiometric titration.

By way of comparison (Comparative Example 2), a conventional neutralization of the rice bran oil is carried out as described above for the Comparative Example 1.

Table 2, below, shows neutralization conditions and the results obtained by the process according to the invention as compared to conventional neutralization. It is observed that the losses of neutral lipids and of oryzanol decrease considerably when the process according to the invention is used as compared with conventional neutralization.

TABLE 2

| Example | Water in ethanol (%) | Neutralization pH | Alkali 5N KOH (ml) | Duration (h) | Free fatty acids (%) | Oryzanol (%) | Losses of oryzanol (%) | Losses of neutral lipids (%) |
|---|---|---|---|---|---|---|---|---|
| 4 | 6 | 9.5 | 6.25 | 16 | 0.14 | 1.5 | 4.5 | 2.4 |
| 5 | 10 | 9.5 | 6.25 | 18 | 0.18 | 1.5 | 4.5 | 1.5 |
| 6 | 15 | 9.5 | 6.25 | 20 | 0.2 | 1.5 | 4.5 | 1 |
| 7 | 20 | 9.5 | 6.25 | 22 | 0.22 | 1.5 | 4.5 | <1 |
| 8 | 10 | 10 | 6.25 | 16 | 0.1 | 1.5 | 4.5 | 1.6 |
| 9 | 10 | 11 | 6.25 | 16 | 0.07 | 1.41 | 10 | 2.6 |
| Comparative 2 | — | — | 8.5 | — | 0.07 | 0.16 | 90 | 13 |

Examples 10–12

A synthetic mixture composed of palm fat containing 51.82% of free fatty acids of the following composition is treated:

| | % |
|---|---|
| Caprylic acid $C_{8:0}$ | 9.27 |
| Capric acid $C_{10:0}$ | 14.83 |
| Lauric acid $C_{12:0}$ | 9.27 |
| Oleic acid $C_{18:1}$ | 66.62 |

To carry out the neutralization, the procedure is carried out in a heterogeneous medium, with vigorous stirring, in the presence of 94% ethanol or of propylene glycol in a simple manner, without using a pH-stat. To control the reaction, the quantity of alkali just necessary for the neutralization, without excess of alkali, is calculated relative to the quantity of free fatty acids present, determined by colorimetric titration (IUPAC 2.201 method). 100 g of fat are introduced into a 400-ml beaker equipped with an anchor-type stirrer; the solvent is added thereto and the mixture is stirred at 125 rpm. An Inlab 424-type pH-measuring electrode (Mettler), connected to a pH-meter 632 (Metrohm), is plunged into the mixture. The mixture is then heated with the aid of an oil bath. When the temperature of the mixture reaches 60–65° C., a 10% aqueous NaOH solution is added dropwise thereto with the aid of a dropping funnel. The pH increases slowly from the initial value of about 3, until the value of 10 is reached, after which the addition of the alkali is stopped. The mixture is further stirred for 30 min while the pH is kept at 10 by addition of a few drops of alkali. The quantity of alkali used corresponds to 0.227 mol, that is to say 101.3%. After that, the stirring is stopped and the mixture is allowed to settle out for 2 h. The light phase, consisting of the neutralized fat, is washed with 50 ml of water, it is dried under vacuum at 70° C./30 mbar, it is weighed and it is analysed.

The heavy phase, composed of the soaps, the solvent and the water, is separated so as to treat it with an acid in order to recover the fatty acids. It is acidified to pH 2.5 with an aqueous solution of 31.6 g of $H_3PO_4$ at 85%. After 2 h of settling out, two phases are formed:

the top phase containing the fatty acids is dried at 70° C./30 mbar and 53.1 g of a fraction containing about 90% of fatty acids are obtained, the bottom phase which contains partially crystallized sodium phosphate in suspension in a mixture of solvent and water. After removing the water by vacuum distillation and filtration of the sodium phosphate, the solvent can be reused for a subsequent operation.

Example 13

A rice bran oil which has been subjected to partial degumming is treated with water in the same manner as in Examples 10–12 above. The quantity of alkali used for the neutralization is 0.03 mol, that is to say 93.4%.

Table 3 shows the neutralization conditions and the results obtained by treating 100 g of fat are indicated in Examples 10–13. In Examples 10–12, the content of residual fatty acids is equal to or less than 0.1%. In Examples 10 and 12, the use of propylene glycol does not generate a loss of neutral lipids greater than 5%. In Example 12, when the rice bran oil is treated, the loss of oryzanol is about 9.1%.

TABLE 3

| Example | Solvent (g) | NaOH 10% (g) | Initial free fatty acids (%) | Final free fatty acids (%) | Initial oryzanol (%) | Final oryzanol (%) | Final yield (g) | Losses of neutral lipids* (%) |
|---|---|---|---|---|---|---|---|---|
| 10 | 100 propylene glycol | 90.8 | 51.82 | 0.1 | — | — | 45.8 | 5 |
| 11 | 100 EtOH | 91 | 51.82 | 0.08 | — | — | 44.6 | 7.5 |
| 12 | 100 polyethylene glycol 200 | 91.5 | 51.82 | 0.09 | — | — | 45.5 | 5.6 |
| 13 | 10 propylene glycol | 13.3 | 9.87 | 0.06 | 1.7 | 1.55 | 87.5 | 3.4 |

Example 14

By carrying out the procedure as in Example 10, with 100 g of degummed and dewaxed millet oil, the settling out of the two phases is complete after 2 h. The quantity of alkali just required for the neutralization used is determined by calorimetric titration and corresponds to 0.047 mol, that is to say 101%. The operating conditions and the results obtained are indicated in Table 4 below.

Example 15

By carrying out the procedure as in Example 10, with 100 g of an interesterified fat prepared according to the process described in European patent application No. 97202289 (EP-A0893064) and which has not been subjected to the last neutralization step, this fat contains about 50–55% of free fatty acids. It was not possible to carry out the exact determination of the content of free fatty acids by acidimetric assay because of the fact that the average molecular weight of the fatty acids is not known. The analysis makes it possible, however, to determine the number of acid equivalents to be neutralized. The quantity of alkali just required for the neutralization used is determined by colorimetric titration and corresponds to 0.225 mol, that is to say 102.8%. The operating conditions and the results obtained are indicated in Table 4 below.

Example 16

Using the procedure of Example 10 with isopropyl alcohol, 2-PrOH, as solvent, 100 g of sunflower oil containing 15% of oleic acid are neutralized. The quantity of alkali just required for the neutralization corresponds to 0.0538 mol, that is to say 101.1%. The operating conditions and the results obtained are indicated in Table 4 below.

TABLE 4

| Example | Solvent (g) | NaOH 10% (g) | Initial free fatty acids (%) | Final free fatty acids (%) | Final yield (g) | Losses of neutral lipids (%) |
|---|---|---|---|---|---|---|
| 14 | 100 propy-lene glycol | 18.8 | 13.1 | 0.1 | 83 | 3.9 |
| 15 | 100 propy-lene glycol | 90.1 | 0.219** | 0.1 | 42.5 | 7.5*** |
| 16 | 100 2-PrOH | 21.5 | 15 | 0.1 | 83 | 2 |

**:This figure relates to the number of fatty acid equivalents to be neutralized.
***:In this example, the loss of neutral lipids is determined by extracting the phase containing the soaps with hexane.

What is claimed is:

1. A process for refining fatty substances that contain fatty acids which comprises:

preparing a reaction medium by mixing the fatty substances with an aqueous medium containing one of an alcohol or a polyol;

removing free fatty acids from the fatty substances in a neutralization step by gradually adding a base to the reaction medium to increase and maintain the pH in the range of about 9 to 11 so as to partition the free fatty acids between a lipid phase and an aqueous phase, containing the alcohol or polyol, which phase is non-miscible with the lipid phase, and to form soaps which are solubilized in the aqueous phase, thus producing a shift in equilibrium and a gradual deacidification of the lipid phase until the pH is stabilized in the range of 9 to 11; and separating the aqueous phase from the lipid phase to obtain the refined fatty substance.

2. The process of claim 1, wherein the neutralization step is carried out in the presence of alcohol, in a homogeneous medium with slow stirring, at a temperature greater than the melting point of the fatty substance and less than the azeotropic boiling point of the aqueous medium.

3. The process of claim 2, wherein, the alcohol is a $C_1$–$C_3$ alcohol.

4. The process of claim 2, wherein the alcohol is ethanol or 2-propanol.

5. The process of claim 1, wherein the neutralization step is carried out in a reactor equipped with a pH electrode, a stirrer and a pH-stat equipped with a burette for delivering aqueous alkaline solution, and the pH-state is connected to the pH electrode so as to provide additional alkaline solution as required to maintain the pH in the range of 9 to 11.

6. The process of claim 5, wherein the reactor is operated to provide stirring conditions such that the lipid phase and the aqueous phase remain separated during the neutralization step to avoid the formation of stable emulsions due to the presence of soaps, and the pH electrode is maintained in contact with the aqueous phase alone.

7. The process of claim 1, wherein the fat:alcohol volume ratio is 1:0.5 to 1:2.5 and the neutralization step is conducted for 6 to 20 h.

8. The process of claim 1, wherein the neutralization step is carried out in a heterogeneous medium, with vigorous stirring, in the presence of the alcohol or polyol at a temperature of 40 to 80° C. without using a pH-stat.

9. The process of claim 8, wherein the quantity of alkali just required for the neutralization is calculated, without excess of alkali, relative to the quantity of free fatty acids present.

10. The process of claim 8, wherein the quantity of free fatty acids present is determined by colorimetric titration.

11. The process of claim 8, wherein the neutralization is carried out in about 60 minutes.

12. The process of claim 1, wherein the polyol is glycerol, propylene glycol, ethylene glycol or a polyalkylene glycol, in particular polyethylene glycol, polypropylene glycol, anhydrous or diluted with water.

13. The process of claim 1, wherein the polyol:fat weight ratio is about 0.5 :10 to 1:1.

14. The process of claim 1, wherein the fatty substance is degummed and dewaxed coffee oil, millet oil or rice bran oil.

15. The process of claim 1, wherein the fatty substance is a synthetic mixture of an interesterified fat.

16. The process of claim 1, wherein the alkali is an aqueous solution of KOH or NaOH at concentrations of 1 to 40% by weight.

* * * * *

UNITED STATES PATENT AND TRADEMARK OFFICE

CERTIFICATE OF CORRECTION

PATENT NO. : 6,506,916 B2 
DATED : January 14, 2003
INVENTOR(S) : Bertholet

It is certified that error appears in the above-identified patent and that said Letters Patent is hereby corrected as shown below:

Title page,
Item [63], Related U.S. Application Data, change "PCT/EP94/05333" to -- PCT/EP99/05333 --.

Signed and Sealed this

Twenty-sixth Day of August, 2003

JAMES E. ROGAN
*Director of the United States Patent and Trademark Office*